US009951666B2

(12) United States Patent
Sato et al.

(10) Patent No.: US 9,951,666 B2
(45) Date of Patent: Apr. 24, 2018

(54) OIL PAN

(71) Applicant: MAHLE FILTER SYSTEMS JAPAN CORPORATION, Tokyo (JP)

(72) Inventors: Kazunari Sato, Saitama (JP); Tsuyoshi Tsukaguchi, Higashikurume (JP); Kazutoyo Endo, Sakado (JP)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 454 days.

(21) Appl. No.: 14/579,600

(22) Filed: Dec. 22, 2014

(65) Prior Publication Data

US 2015/0184562 A1 Jul. 2, 2015

(30) Foreign Application Priority Data

Dec. 26, 2013 (JP) ..... 2013-268412

(51) Int. Cl.
*F01M 11/00* (2006.01)

(52) U.S. Cl.
CPC . *F01M 11/0004* (2013.01); *F01M 2011/0091* (2013.01)

(58) Field of Classification Search
CPC ..... F01M 11/0004; F01M 2011/0091
USPC ..... 184/6.22, 106; 123/195 C
See application file for complete search history.

(56) References Cited

U.S. PATENT DOCUMENTS 4,898,261 A * 2/1990 Winberg ..... F01M 5/002 123/195 C
6,131,543 A * 10/2000 Achenbach ..... F01M 11/0004 123/195 C
6,584,950 B1 * 7/2003 Cunningham ..... F01M 11/0004 123/195 C (Continued)

FOREIGN PATENT DOCUMENTS

EP 2 330 276 A1 6/2011
JP 1-80581 U 5/1989

(Continued)

OTHER PUBLICATIONS

European Search Report dated May 6, 2015, 6 pgs.

*Primary Examiner* — William E Dondero
*Assistant Examiner* — Mark K Buse
(74) *Attorney, Agent, or Firm* — Foley & Lardner LLP

(57) ABSTRACT

[OBJECT] To provide a resin-made oil pan without breakage even when the oil pan strikes against an obstruction.
[MEANS TO SOLVE] A bottom wall 2 of an oil pan 1 made of resin material has a front side wall section 5 that is located at a vehicle front side and a rear side wall section 6 that is located at a vehicle rear side with respect to the front side wall section 5 and continues to the front side wall section 5 at a predetermined angle. The front side wall section 5 is set so as to have an inclination so that as a position on the front side wall section 5 gets closer to the vehicle rear side, the position on the front side wall section 5 is located in a lower position in a vehicle up-and-down direction in a state in which the oil pan 1 is secured to a cylinder block mounted (Continued)

on a vehicle. As an external force absorption means, a plurality of lateral ribs 7, each of which has an almost rectangular shape in cross section and extends along a vehicle width direction, are formed on an outer wall surface 5*a* of the front side wall section 5.

7 Claims, 14 Drawing Sheets

(56) References Cited

U.S. PATENT DOCUMENTS 6,705,270 B1 * 3/2004 Rau ..... F01M 11/0004 123/195 C
6,799,792 B2 * 10/2004 Jurica ..... B21D 13/00 29/897.2
7,481,196 B2 * 1/2009 Jessberger ..... B60R 19/00 123/195 C
7,731,271 B2 * 6/2010 Shelbo ..... B21D 13/045 296/182.1
8,776,757 B2 * 7/2014 Goerend ..... F01M 11/0004 123/195 C
9,540,972 B2 * 1/2017 Hanley ..... F01M 11/0004
2002/0100641 A1 * 8/2002 Osman ..... F01M 11/0004 184/106
2006/0278099 A1 * 12/2006 Jessberger ..... B60R 19/00 99/446
2011/0147128 A1 * 6/2011 Schrade ..... B29C 45/22 184/106
2012/0251788 A1 * 10/2012 Hanley ..... F01M 11/0004 428/167
2014/0216852 A1 * 8/2014 Griffiths ..... B32B 1/02 184/106
2015/0252696 A1 * 9/2015 Taguchi ..... F01M 11/0004 123/198 E
2016/0222846 A1 * 8/2016 Mizoguchi ..... F02F 11/00

FOREIGN PATENT DOCUMENTS

JP 2012-154298 A 8/2012
JP 2013-107474 A 6/2013

* cited by examiner (A)

(B)

(C)

VEHICLE FRONT SIDE

VEHICLE FRONT SIDE

OIL PAN

TECHNICAL FIELD

The present invention relates to a resin-made oil pan that is secured to a lower portion of an engine or a transmission mounted on a vehicle and stores lubricating oil.

BACKGROUND ART

The oil pan for the vehicle is generally made of metal because when the oil pan strikes against an obstruction on a road such as a curb then breaks, the oil leaks to the outside.

Meanwhile, weight reduction of the vehicle and use of resin for parts have been progressing in recent years, and there has been a demand that the resin should be used for the oil pan too.

For instance, Patent Document 1 discloses a resin-made oil pan having an impact absorption structure.

This impact absorption structure of the Patent Document 1 is formed from a plurality of impact absorption inner ribs that are formed on and protrude from a lower surface of a bottom wall of the oil pan, a protector cover that covers a lower side of the bottom wall of the oil pan and a plurality of impact absorption outer ribs that are formed on and protrude from this protector cover. The impact absorption structure absorbs the impact of stone chipping etc., which hit the oil pan, by deformation etc. of the impact absorption inner ribs, the impact absorption outer ribs and the protector cover.

CITATION LIST

Patent Document

[Patent Document 1]

Japanese Patent Application Kokai Publication No. 2012-154298

SUMMARY OF THE INVENTION

Technical Problem

However, if such an impact absorption structure of the Patent Document 1 is employed, since the protector cover, which is a separate reinforcing part, is fixed to an outer side of the oil pan, an entire weight of the oil pan increases, and this causes a problem of lessening an advantage obtained by the fact that the oil pan is made of resin.

Technical Solution

An oil pan made of resin material of the present invention is disposed at a lower portion of the vehicle. The oil pan of the present invention comprises: a bottom wall having a front side wall section that is located at a vehicle front side and a rear side wall section that is horizontally located at a vehicle rear side with respect to the front side wall section and continues to the front side wall section at a predetermined angle; and an external force absorption section that is provided at the front side wall section and inclines downward in a vehicle up-and-down direction toward the vehicle rear side and moderates and absorbs an external force that is inputted to the front side wall section.

More specifically, the external force absorption section is a plurality of resin-made lateral ribs that protrude from an outer wall surface of the front side wall section so as to extend along a vehicle width direction, or a curved wall of the front side wall section, which curves at a predetermined curvature so as to bulge downward in the vehicle up-and-down direction, or a resin-made plate spring that is welded to the front side wall section, or a plurality of resin-made longitudinal ribs that protrude from an outer wall surface of the front side wall section so as to extend along a vehicle front-and-rear direction. Here, the longitudinal rib is formed so that a vehicle rear side portion of the longitudinal rib is relatively thick and a top end of the vehicle rear side portion of the longitudinal rib becomes relatively thinner toward the vehicle front side.

A part of an external force (an impact force) that is inputted to the oil pan when the oil pan strikes against an obstruction is converted from a force of a vehicle travelling direction to a force of the vehicle up-and-down direction by the inclination, along the vehicle front-and-rear direction, of the front side wall section. Therefore, a part of the external force inputted to the oil pan when the oil pan strikes against the obstruction can be moderated and absorbed using an engine-mount and a suspension. Further, also by the external force absorption section, a part of the external force inputted to the oil pan when the oil pan strikes against the obstruction can be moderated and absorbed.

Effects of the Invention

According to the present invention, since it is possible to decrease the external force substantially inputted to the oil pan when the oil pan strikes against the obstruction, the resin-made oil pan without breakage even when the oil pan strikes against the obstruction can be obtained without thickening a thickness of the oil pan (without increasing weight of the oil pan).

BRIEF DESCRIPTION OF DRAWINGS

FIG. 5(A) shows a state when the oil pan strikes against the obstruction.

FIG. 5(B) shows a state in which the oil pan is going to run on or ride on the obstruction after striking against the obstruction.

FIG. 5(C) shows a state when the oil pan runs on or rides on the obstruction.

EMBODIMENTS FOR CARRYING OUT THE INVENTION

Figure 1:
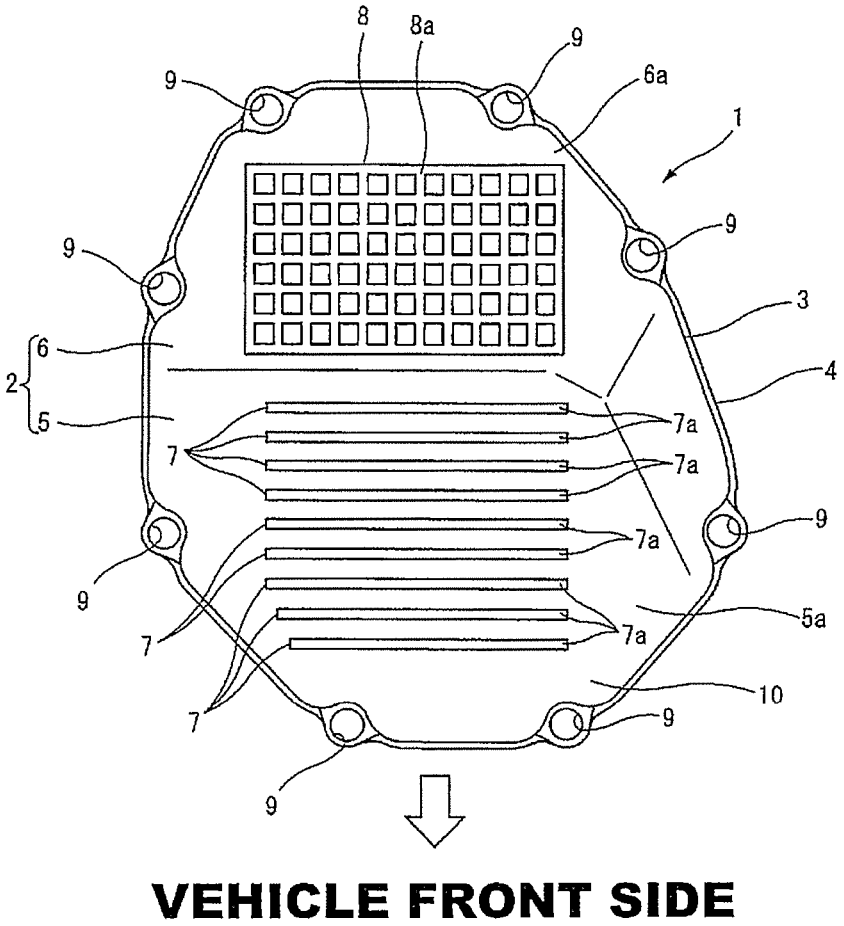
FIG. 1 is a bottom view of an oil pan according to a first embodiment of the present invention.
Figure 2:
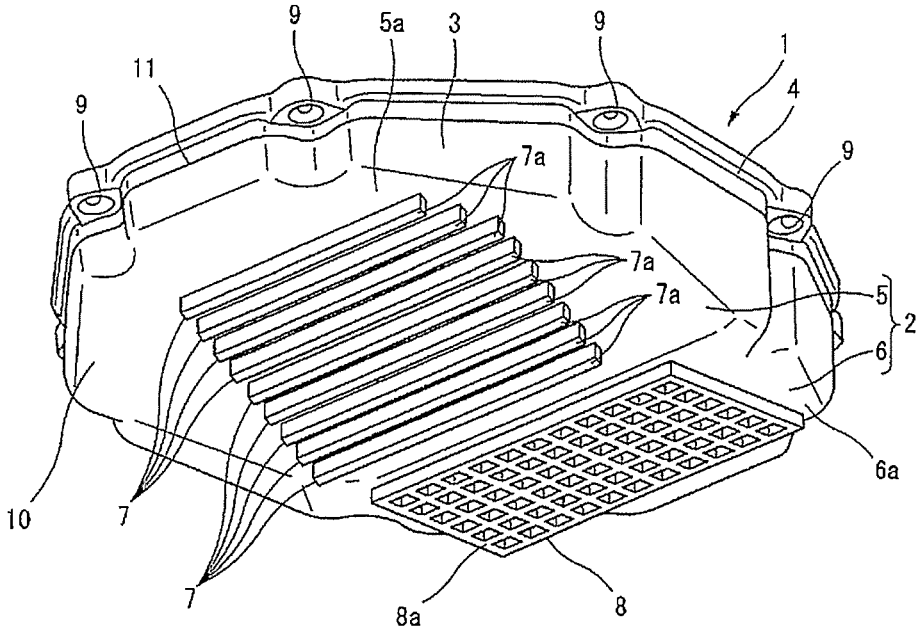
FIG. 2 is a perspective view, viewed from a lower side, of the oil pan of the first embodiment of the present invention.
Figure 3:
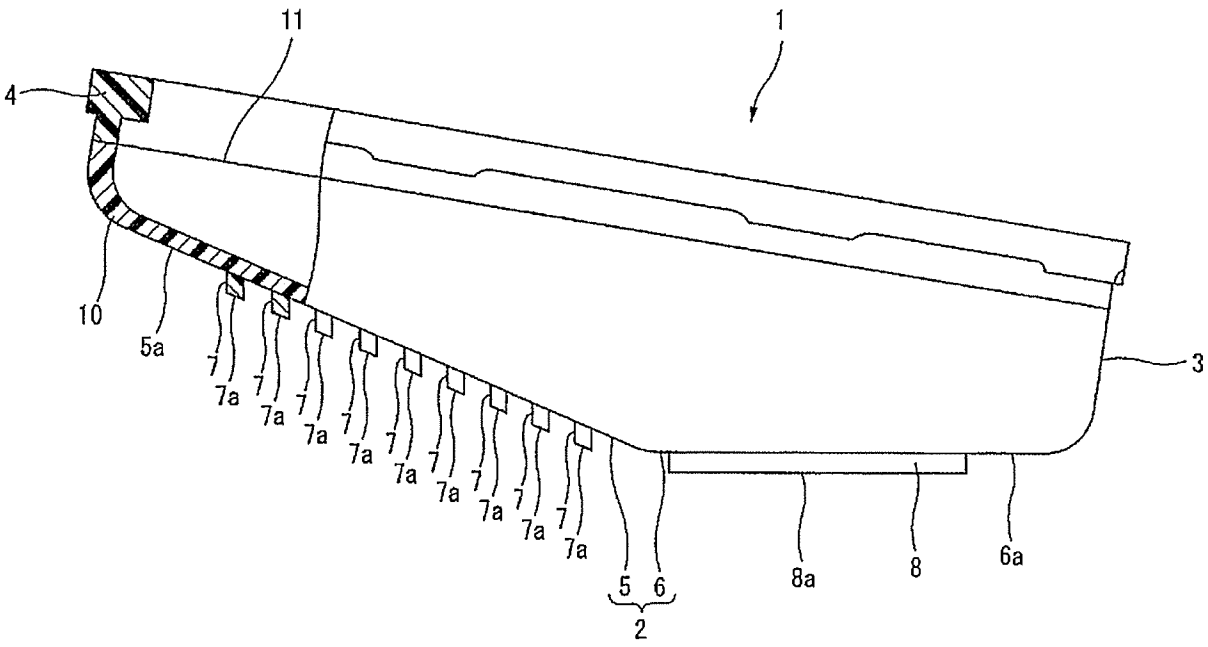
FIG. 3 is a drawing, viewed from a side direction, for explaining a structure of the oil pan of the first embodiment of the present invention.

In the following description, embodiments of the present invention will be explained on the basis of the drawings. FIGS. 1 to 3 are explanatory drawings schematically showing an oil pan 1 of a first embodiment of the present invention. FIG. 1 is a bottom view of the oil pan 1 of the first embodiment. FIG. 2 is a perspective view, viewed from a lower side, of the oil pan 1 of the first embodiment. FIG. 3 is a drawing, viewed from a side direction, for explaining a structure of the oil pan 1 of the first embodiment.

The oil pan 1 is made of resin material (e.g. nylon resin). The oil pan 1 is secured to a lower surface of a cylinder block (not shown) of an internal combustion engine mounted on a vehicle, and stores lubricating oil supplied to each part of the internal combustion engine.

This oil pan 1 has a substantially dish or pan shape. The oil pan 1 is formed mainly from a bottom wall 2 whose thickness is a substantially constant, a side wall 3 whose thickness surrounding a circumference of the bottom wall 2 is a substantially constant and a brim-shaped flange 4 secured to a lower end of the cylinder block.

The bottom wall 2 of the oil pan 1 has a front side wall section 5 located at a front side of the vehicle and a rear side wall section 6 continuing to the front side wall section 5 at a predetermined angle and located at a rear side of the vehicle with respect to the front side wall section 5.

The front side wall section 5 is set so as to have an inclination so that as a position on the front side wall section 5 gets closer to the vehicle rear side, the position on the front side wall section 5 is located in a lower position in a vehicle up-and-down direction in a state in which the oil pan 1 is secured to the cylinder block mounted on the vehicle. In other words, the front side wall section 5 has an outer wall surface 5*a* formed into a single flat surface, and the outer wall surface 5*a* inclines or slopes downward toward the vehicle rear side in the state in which the oil pan 1 is secured to the cylinder block mounted on the vehicle.

As an external force absorption section (an external force absorption means), a plurality of lateral ribs 7 are formed on the outer wall surface 5*a* of the front side wall section 5. The lateral rib 7 is a protruding line having a substantially rectangular shape in cross section and extending along a vehicle width direction. The lateral ribs 7 are provided at almost regular intervals in a vehicle front-and-rear direction. In other words, the lateral ribs 7 are provided so as to be substantially orthogonal to a vehicle travelling direction. A top end surface 7*a* of each lateral rib 7 is formed so as to be substantially parallel to the outer wall surface 5*a*. Further, the top end surface 7*a* of each lateral rib 7 is formed by a single and same flat surface. Here, the lateral ribs 7 are not limited to the lateral ribs provided at the almost regular intervals in the vehicle front-and-rear direction. The lateral ribs 7 could be provided at irregular intervals in the vehicle front-and-rear direction.

The rear side wall section 6 is set in a substantially horizontal position, namely that the rear side wall section 6 is set so as to be substantially parallel to a road surface, in the state in which the oil pan 1 is secured to the cylinder block mounted on the vehicle. A lattice rib 8 formed from a plurality of protruding lines extending along the vehicle width direction and a plurality of protruding lines extending along the vehicle front-and-rear direction is formed on a substantially whole surface of an outer wall surface 6*a* of the rear side wall section 6. A top end surface 8*a* of the lattice rib 8 is formed by a single flat surface, and also is formed so as to be substantially parallel to the outer wall surface 6*a*.

The flange 4 is formed throughout an entire circumference of an upper portion of the side wall 3. The flange 4 is provided, in a plurality of positions, with bolt insertion holes 9 into which bolts (not shown) for fixing the oil pan 1 to the cylinder block are inserted.

Figure 4:
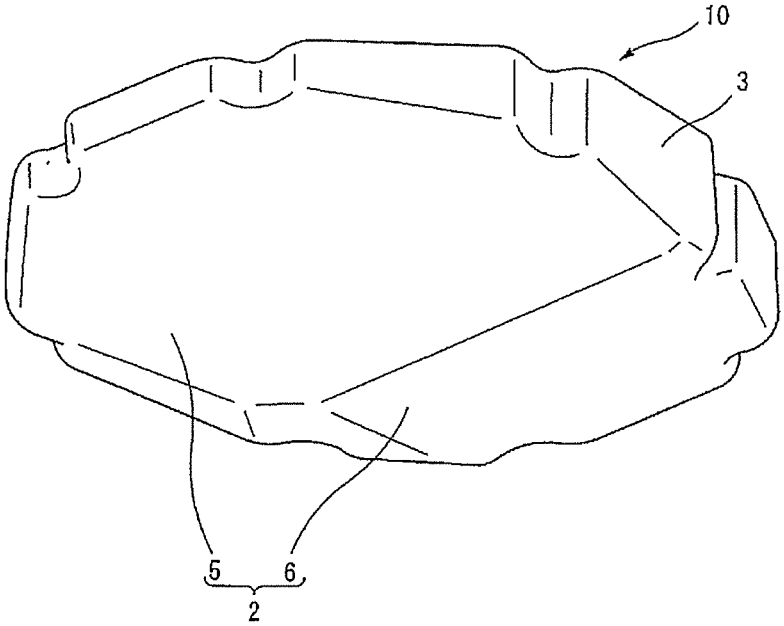
FIG. 4 is a perspective view, viewed from the lower side, of a bottom unit that forms the oil pan of the first embodiment of the present invention.

Here, the oil pan 1 of the present embodiment has a structure in which a bottom wall 2 side part of the bottom wall 2 and the side wall 3 is formed from a substantially dish-shaped or pan-shaped bottom unit 10 as shown in FIG. 4 and strength of the bottom wall 2 side is relatively high. This bottom unit 10 is made of fiber reinforced plastics (FRP), for instance, with nylon resin being a base metal (or a parent metal) and glass fiber being a reinforcement. That is, the oil pan 1 is formed by fixing such a bottom unit 10 in a certain mold or die (not shown) and filling this mold with melted resin and molding a remaining part of the side wall 3 (i.e. a flange 4 side part of the side wall 3), the flange 4, the plurality of lateral ribs 7 of the front side wall section 5 and the lattice rib 8 of the rear side wall section 6. Here, a reference sign 11 in FIG. 2 is a parting line between the bottom unit 10 and a part of the side wall 3 molded to the bottom unit 10.

Figure 5:
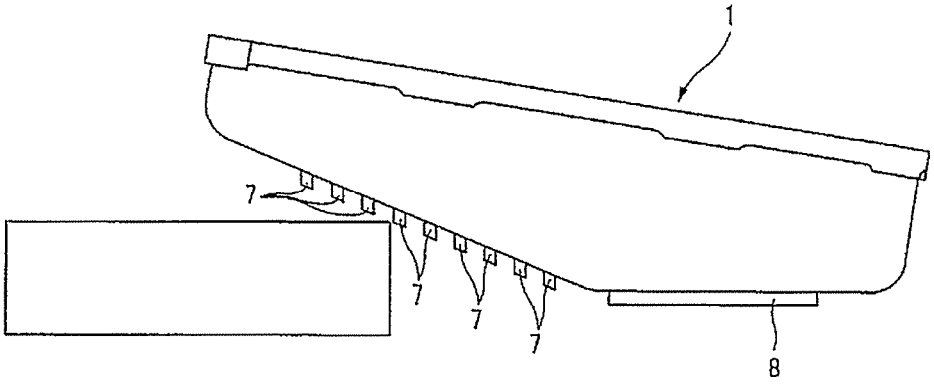
FIG. 5 are drawings for explaining a situation when the oil pan of the first embodiment of the present invention strikes against an obstruction in time series.
Figure 5:
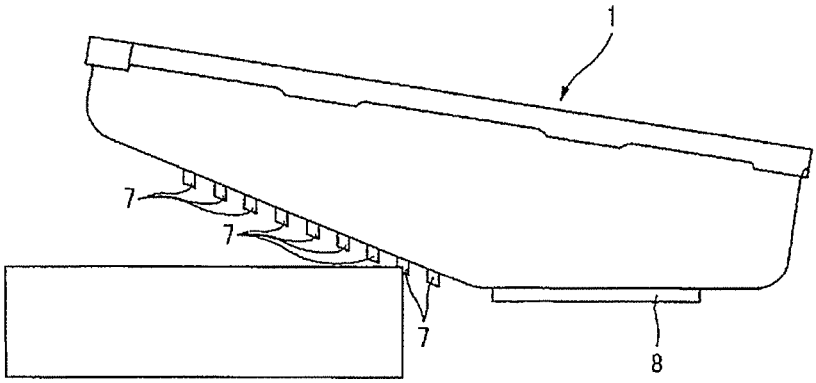
Figure 5:
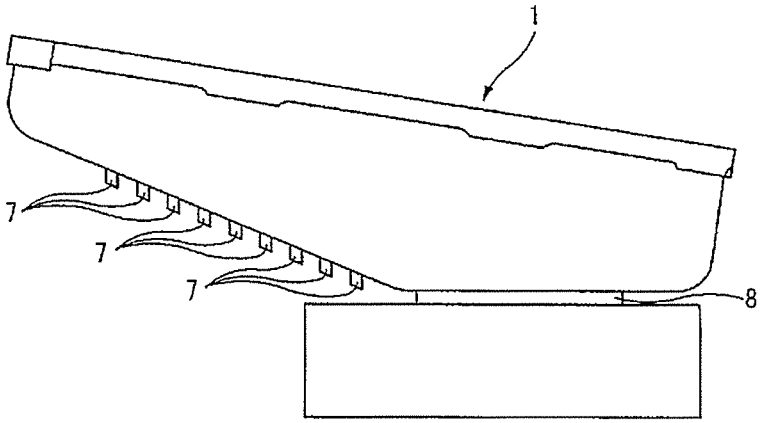

In a case where the oil pan 1 of the first embodiment formed in such a manner strikes against an obstruction such as a curb, as shown in FIG. 5(A), the obstruction hits the lateral rib 7 of the external force absorption section (the external force absorption means) which is provided at the front side wall section 5 of the bottom wall 2. At this time, a part of an external force (an impact force) that is inputted to the oil pan 1 can be moderated and absorbed by deformation and breakage of this lateral rib 7.

Then, as shown in FIG. 5(B), by the inclined front side wall section 5 and the inclined top end surface 7*a* of the lateral rib 7, the oil pan 1 can run on or ride on the obstruction while converting the external force inputted from the obstruction to the oil pan 1 to a force of the vehicle up-and-down direction. Further, the force of the vehicle up-and-down direction, converted by the inclination of the front side wall section 5, among the external force inputted to the oil pan 1 is moderated and absorbed using an engine-mount and a suspension. When the oil pan 1 rides on the obstruction, as shown in FIG. 5(C), a vehicle body can be supported by the lattice rib 8 provided at the rear side wall section 6.

That is, by providing the front side wall section 5 inclined in the vehicle front-and-rear direction at the bottom wall 2 of the oil pan 1 and also providing at this front side wall section 5 the lateral rib 7 that moderates and absorbs the external force from the obstruction, it is possible to decrease the external force substantially inputted to the oil pan 1 when the oil pan 1 strikes against the obstruction. Thus, the resin-made oil pan 1 without breakage even when the oil pan 1 strikes against the obstruction can be obtained without thickening a thickness of the oil pan 1 (without increasing weight of the oil pan 1). In addition, since the top end surface 7*a* of the lateral rib 7 is inclined so as to be substantially parallel to the outer wall surface 5*a* of the front side wall section 5, the oil pan 1 easily rides on the obstruction.

Here, in the first embodiment described above, the outer wall surface 5*a* of the front side wall section 5 is formed by the single flat surface. However, the outer wall surface 5*a*, at the vehicle front side, of the front side wall section 5 could be formed into an almost cone shape surface in a range of 180° viewed from the front. Further, a cross sectional shape of the lateral rib 7 is not limited to the rectangular shape. For instance, it could be an almost reverse T-letter shape in cross section or an almost L-letter shape in cross section. In this case, when the obstruction hits the top end of the lateral rib 7, only the top end side of the lateral rib 7 breaks, and this structure has an advantage in avoiding an occurrence of the breakage or chip of the front side wall section 5 due to the strike.

In the following description, other embodiments will be explained. Here, the same element or component as that of the first embodiment above is indicated by the same reference sign, and overlapping explanation will be omitted.

Figure 6:
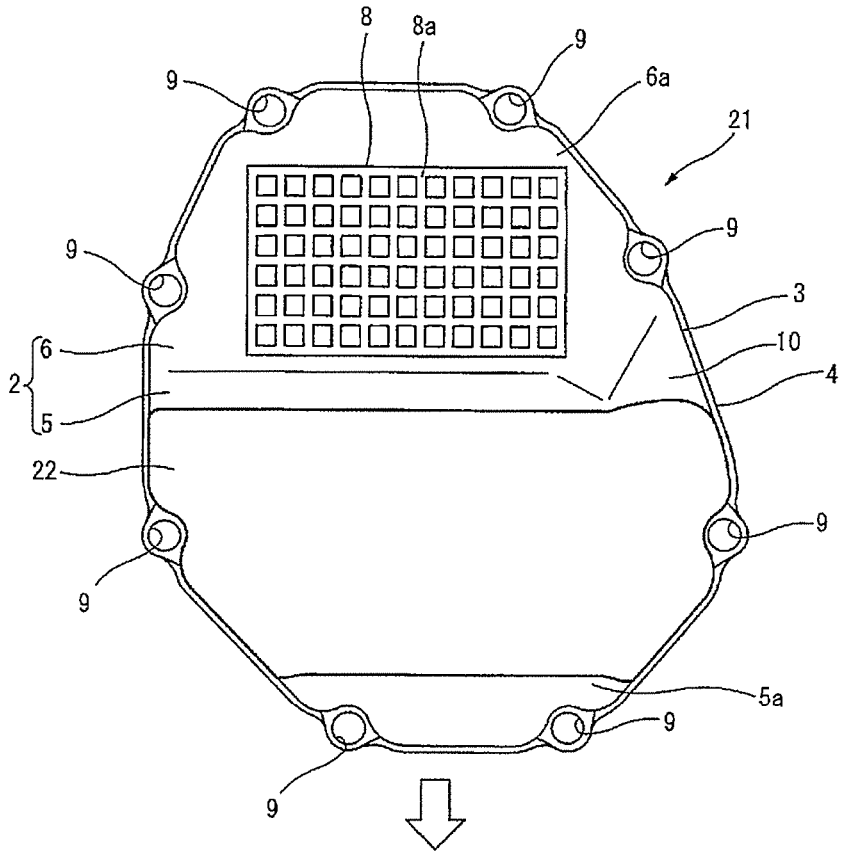
FIG. 6 is a bottom view of an oil pan according to a second embodiment of the present invention.
Figure 7:
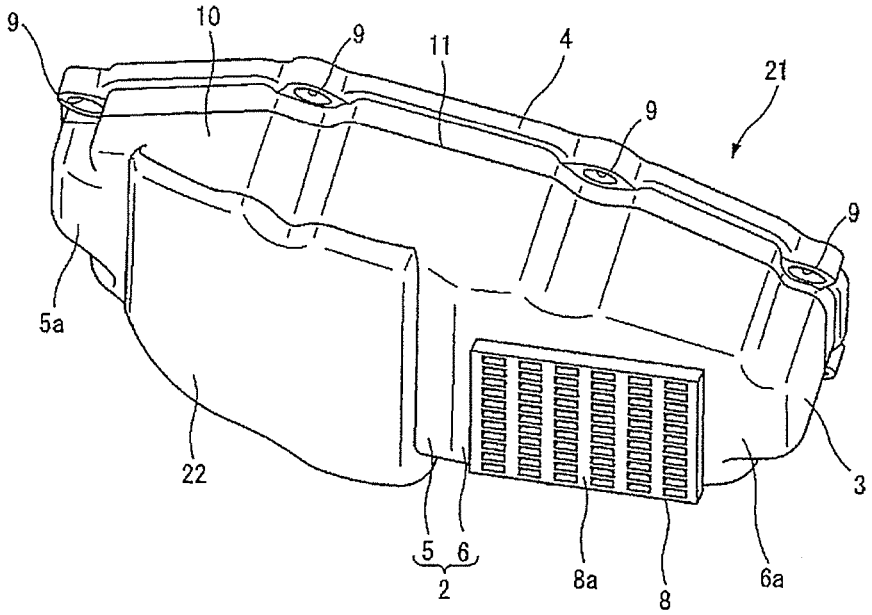
FIG. 7 is a perspective view, viewed from the lower side, of the oil pan of the second embodiment of the present invention.
Figure 8:
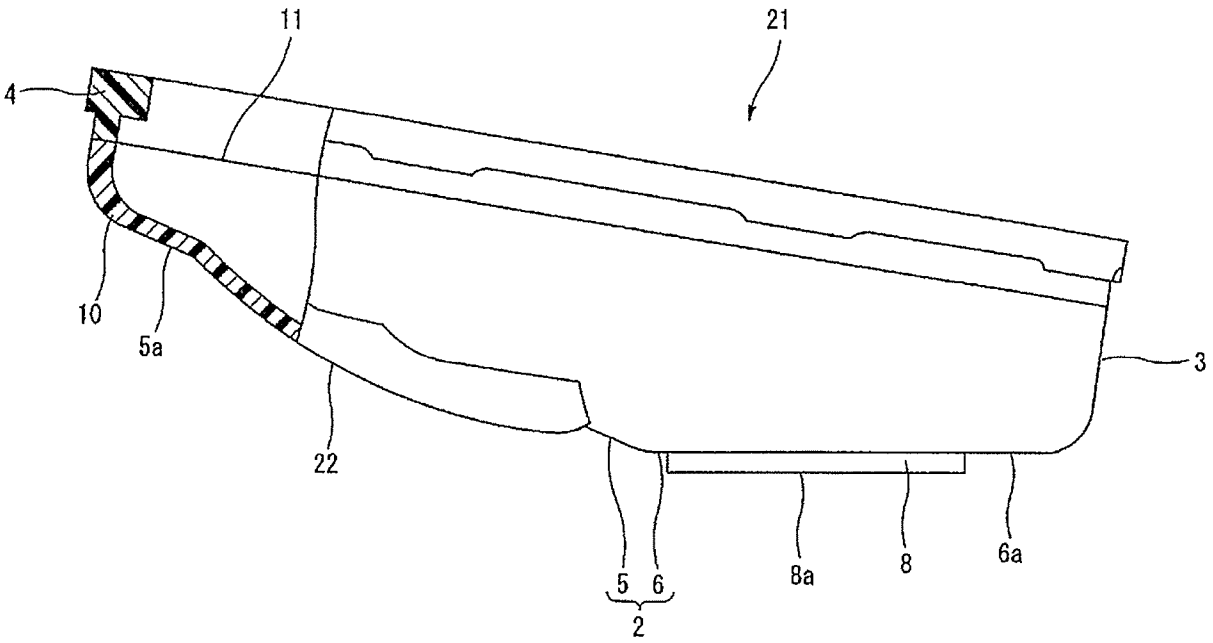
FIG. 8 is a drawing, viewed from the side direction, for explaining a structure of the oil pan of the second embodiment of the present invention.

FIGS. 6 to 8 are explanatory drawings schematically showing an oil pan 21 of a second embodiment of the present invention. FIG. 6 is a bottom view of the oil pan 21 of the second embodiment. FIG. 7 is a perspective view, viewed from the lower side, of the oil pan 21 of the second embodiment. FIG. 8 is a drawing, viewed from the side direction, for explaining a structure of the oil pan 21 of the second embodiment.

Although this oil pan 21 of the second embodiment has almost the same structure as that of the oil pan 1 of the first embodiment described above, the lateral rib 7 is not provided, but the front side wall section 5 of the bottom wall 2 is provided with a curved wall 22 that has an inclination so that as a position on the curved wall 22 gets closer to the vehicle rear side, the curved wall 22 as a whole is located in a lower position in the vehicle up-and-down direction in the state in which the oil pan 21 is secured to the cylinder block mounted on the vehicle and also curves at a predetermined curvature so as to bulge or swell downward in the vehicle up-and-down direction. In other words, the curved wall 22, the whole of which inclines or slopes downward toward the vehicle rear side in the state in which the oil pan 21 is secured to the cylinder block mounted on the vehicle, and which bulges or swells downward in the vehicle up-and-down direction, also which curves at the predetermined curvature along the vehicle front-and-rear direction (along an up-and-down direction in FIG. 6), is formed on an area forming the front side wall section 5 of the bottom wall 2 of the bottom unit 10. In this second embodiment, the curved wall 22 corresponds to the external force absorption section (the external force absorption means).

In the second embodiment described above, in a case where the oil pan 21 strikes against the obstruction such as the curb, the obstruction hits the curved wall 22 bulging or swelling downward in the vehicle up-and-down direction at the predetermined curvature. At this time, a direction of curve (curvature) of the curved wall 22 is reversed by the external force (the impact force) when the obstruction hits the curved wall 22 so as to bulge or swell upward in the vehicle up-and-down direction (so as to bulge or swell toward an inside of the oil pan). That is, a part of the external force (the impact force) that is inputted to the oil pan 21 is consumed as energy when reversing the curved wall 22. It is therefore possible to decrease the external force substantially inputted to the oil pan 21 when the oil pan 21 strikes against the obstruction. In addition, even though the direction of the curve (the curvature) of the curved wall 22 is reversed, since the curved wall 22 has the inclination so that as the position on the curved wall 22 gets closer to the vehicle rear side, the curved wall 22 as a whole is located in the lower position in the vehicle up-and-down direction, the oil pan 21 can ride on the obstruction while converting the external force inputted from the obstruction to the oil pan 21 to a force of the vehicle up-and-down direction.

Hence, also in this second embodiment, almost the same working and effect as those of the first embodiment can be obtained, and the resin-made oil pan 21 without breakage even when the oil pan 21 strikes against the obstruction can be obtained without thickening a thickness of the oil pan 21 (without increasing weight of the oil pan 21).

Here, the front side wall section 5 as a whole could be the curved wall 22.

Figure 9:
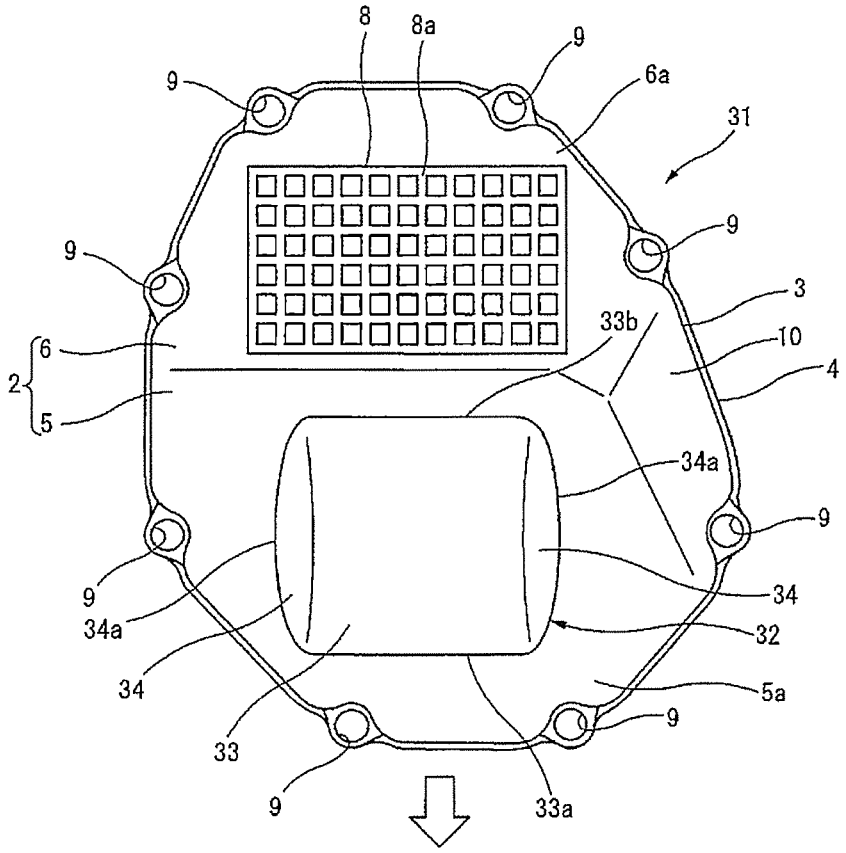
FIG. 9 is a bottom view of an oil pan according to a third embodiment of the present invention.
Figure 10:
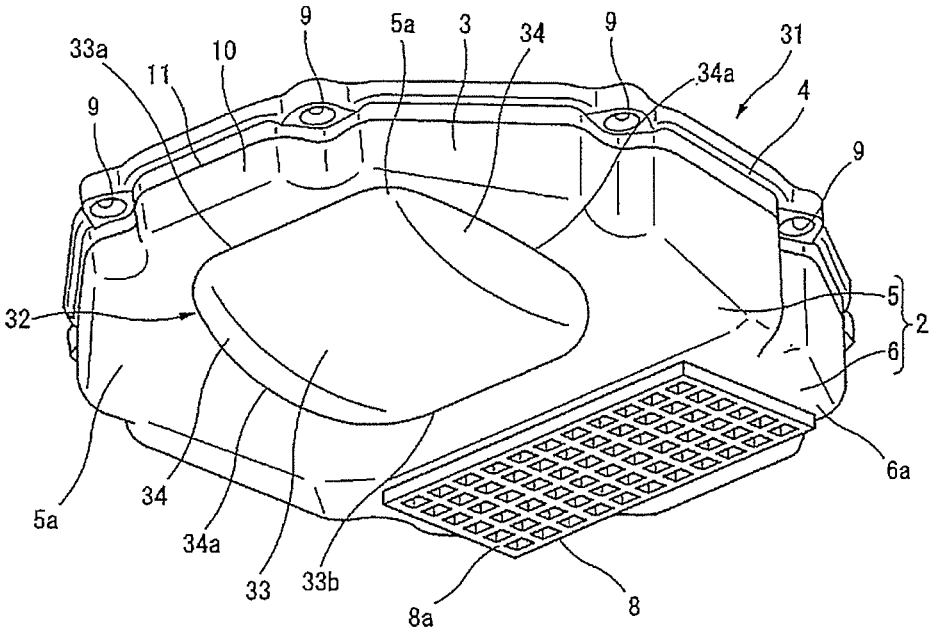
FIG. 10 is a perspective view, viewed from the lower side, of the oil pan of the third embodiment of the present invention.
Figure 11:
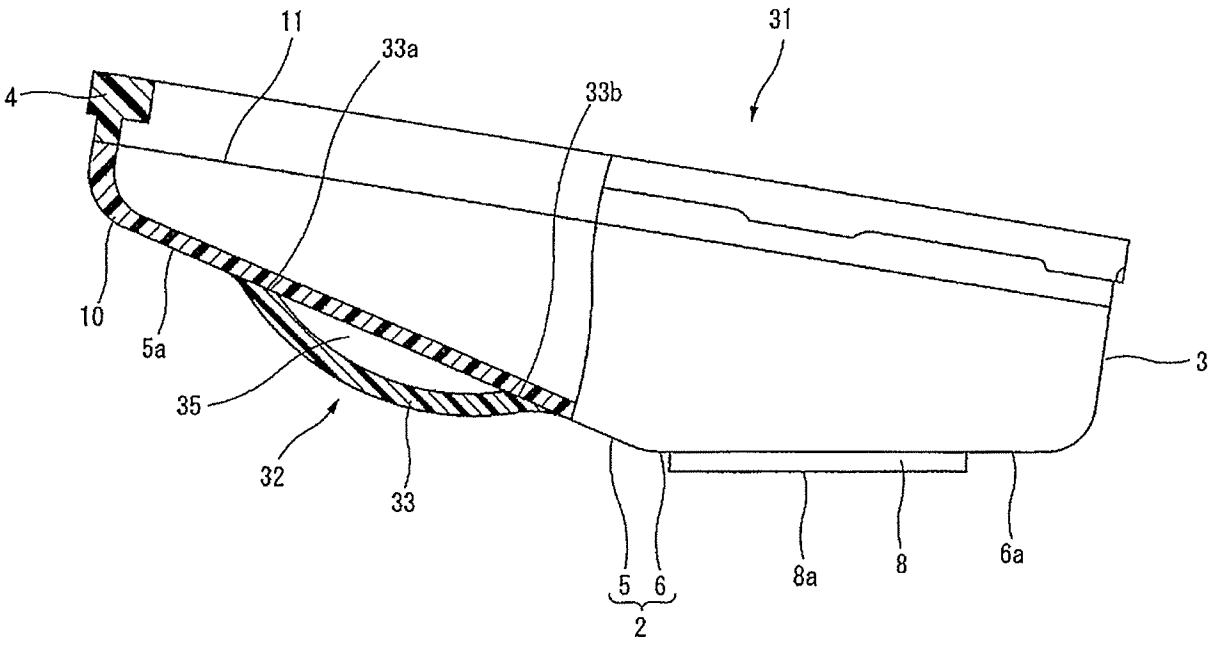
FIG. 11 is a drawing, viewed from the side direction, for explaining a structure of the oil pan of the third embodiment of the present invention.

FIGS. 9 to 11 are explanatory drawings schematically showing an oil pan 31 of a third embodiment of the present invention. FIG. 9 is a bottom view of the oil pan 31 of the third embodiment. FIG. 10 is a perspective view, viewed from the lower side, of the oil pan 31 of the third embodiment. FIG. 11 is a drawing, viewed from the side direction, for explaining a structure of the oil pan 31 of the third embodiment.

Although this oil pan 31 of the third embodiment has almost the same structure as that of the oil pan 1 of the first embodiment described above, a resin-made cup-shaped member 32 that functions as a plate spring (or a flat spring) instead of the lateral rib 7 is attached to the front side wall section 5. In this third embodiment, the cup-shaped member 32 corresponds to the external force absorption section (the external force absorption means).

The cup-shaped member 32 has a curved wall 33 that curves at a predetermined curvature so as to bulge or swell downward in the vehicle up-and-down direction and a pair of cup side walls 34, 34 that are located at both sides of the curved wall 33 and have an arch shape (or a bow shape) along a curved-shape of the curved wall 33. A general shape of the cup-shaped member 32 is an almost rectangular cup shape.

The cup-shaped member 32 is welded to the outer wall surface 5*a* of the front side wall section 5 throughout an entire circumference of an outer circumferential edge of the cup-shaped member 32, and a space 35 having an almost arch or bow shape in cross section is defined between the outer wall surface 5*a* of the front side wall section 5 and the cup-shaped member 32 at an inner circumferential side. More specifically, front and rear edges 33*a*, 33*b* of the curved wall 33 and flat base edges 34*a*, 34*a* of the pair of cup side walls 34, 34 of the cup-shaped member 32 are welded to the outer wall surface 5*a* of the front side wall section 5 with the curved wall 33 curving along the vehicle front-and-rear direction (along an up-and-down direction in FIG. 9). The cup-shaped member 32 functions as the plate spring by the fact that the cup-shaped member 32 is elastically deformed so that the space 35 is squashed by an external input.

In the third embodiment described above, when the obstruction hits the cup-shaped member 32 of the front side wall section 5, while the cup-shaped member 32 is elastically deformed so that the space 35 is squashed, the oil pan 31 bounces in reaction to this elastic deformation and rides on the obstruction. That is, a part of the external force (the impact force) that is inputted to the oil pan 31 is consumed as energy when the cup-shaped member 32 is elastically deformed and the oil pan 31 bounces by the cup-shaped member 32. It is therefore possible to decrease the external force substantially inputted to the oil pan 31 when the oil pan 31 strikes against the obstruction.

Hence, also in this third embodiment, almost the same working and effect as those of the first embodiment can be obtained, and the resin-made oil pan 31 without breakage even when the oil pan 31 strikes against the obstruction can be obtained without thickening a thickness of the oil pan 31 (without increasing weight of the oil pan 31).

Here, regarding the cup-shaped member 32, a penetration hole could be formed on the curved wall 33 and/or the cup side wall 34 in order that pressure in the space 35 does not become high when the oil pan 31 strikes against the obstruction.

Figure 12:
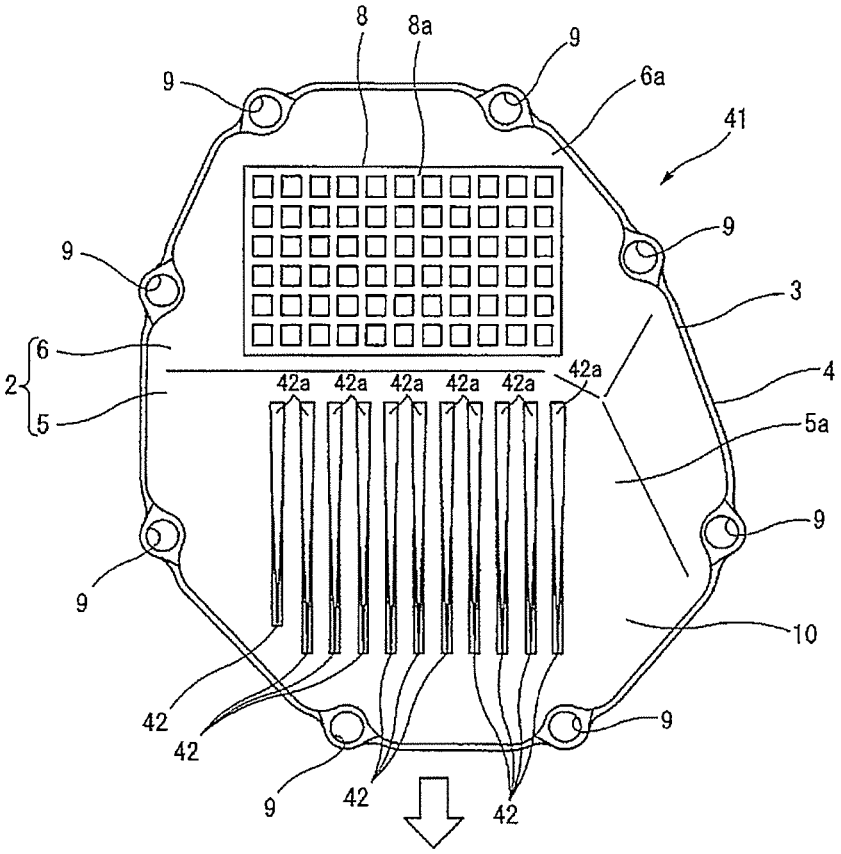
FIG. 12 is a bottom view of an oil pan according to a fourth embodiment of the present invention.
Figure 13:
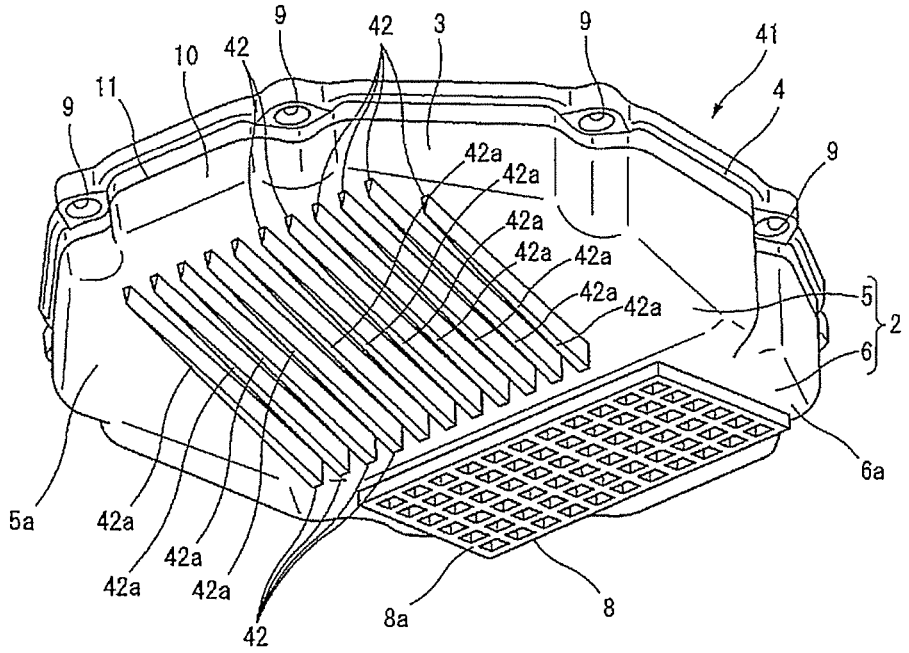
FIG. 13 is a perspective view, viewed from the lower side, of the oil pan of the fourth embodiment of the present invention.
Figure 14:
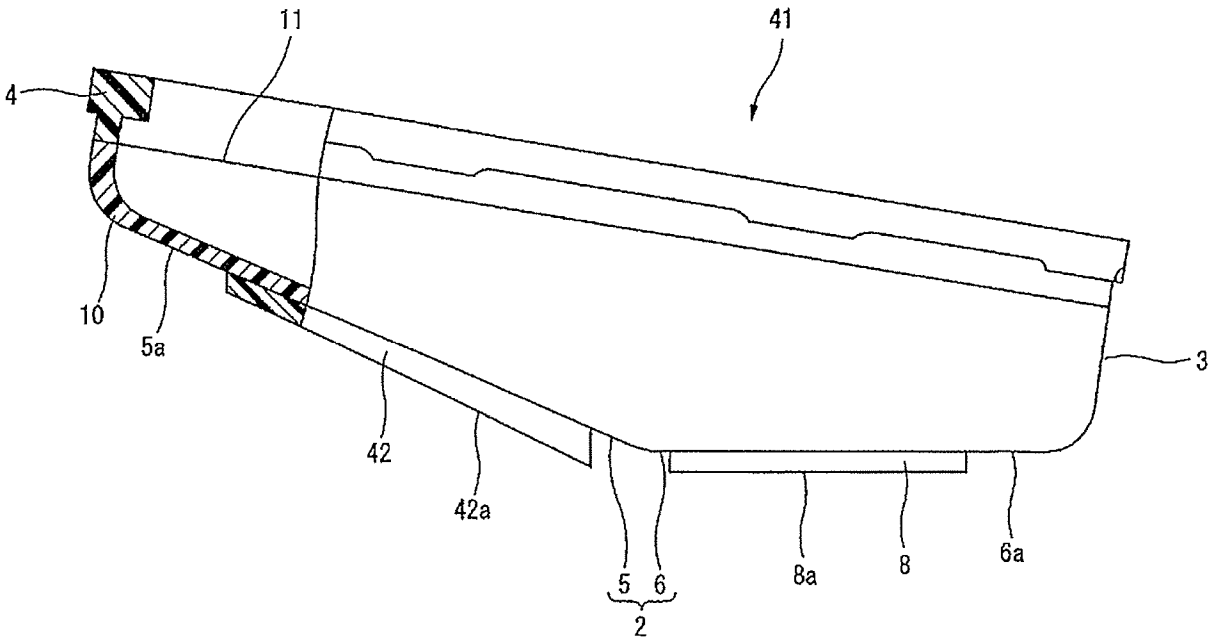
FIG. 14 is a drawing, viewed from the side direction, for explaining a structure of the oil pan of the fourth embodiment of the present invention.

FIGS. 12 to 14 are explanatory drawings schematically showing an oil pan 41 of a fourth embodiment of the present invention. FIG. 12 is a bottom view of the oil pan 41 of the fourth embodiment. FIG. 13 is a perspective view, viewed from the lower side, of the oil pan 41 of the fourth embodiment. FIG. 14 is a drawing, viewed from the side direction, for explaining a structure of the oil pan 41 of the fourth embodiment.

Although this oil pan 41 of the fourth embodiment has almost the same structure as that of the oil pan 1 of the first embodiment described above, instead of the lateral rib 7, a plurality of resin-made longitudinal ribs 42 that protrude downward and extend along the vehicle front-and-rear direction are formed on the outer wall surface 5*a* of the front side wall section 5. In this fourth embodiment, the longitudinal rib 42 corresponds to the external force absorption section (the external force absorption means).

The longitudinal rib 42 is a protruding line that is formed so that a vehicle rear side portion of the protruding line is relatively thick and its top end becomes relatively thinner toward the vehicle front side. The longitudinal ribs 42 are provided at almost regular intervals in the vehicle width direction. More specifically, the longitudinal rib 42 is formed so that a front end, located at the vehicle front side, of the longitudinal rib 42 is shaped into a wedge shape in cross section and its top end (i.e. wedge-shaped apex) is flattened and becomes an isosceles trapezoid in cross section toward the vehicle rear side, then the longitudinal rib 42 has a rectangular shape in cross section. That is, the longitudinal rib 42 is formed so that the cross sectional shape of the longitudinal rib 42 gradually and continuously changes from the wedge shape to the isosceles trapezoid and further to the rectangular shape from the vehicle front side toward the vehicle rear side. Further, the longitudinal rib 42 is set so that as a position on the longitudinal rib 42 gets closer to the vehicle rear side, a protruding amount, from the outer wall surface 5*a* of the front side wall section 5, of the longitudinal rib 42 becomes greater. A top end 42*a* of each longitudinal rib 42 is formed by a single and same flat surface. Here, the longitudinal ribs 42 are not limited to the longitudinal ribs provided at the almost regular intervals in the vehicle width direction. The longitudinal ribs 42 could be provided at irregular intervals in the vehicle width direction.

The obstruction such as the curb basically gets closer to or comes to the oil pan 41 from the vehicle front side. Therefore, the obstruction hits a front side, located at the vehicle front side, of the longitudinal rib 42.

That is, in this fourth embodiment, it is possible to decrease the external force substantially inputted to the oil pan 41 when the oil pan 41 strikes against the obstruction by the fact that the front side of the longitudinal rib 42, which is located at the vehicle front side and strikes against the obstruction, is deformed or breaks. Further, since the longitudinal rib 42 relatively becomes thicker toward the vehicle rear side and its rigidity relatively becomes higher, the oil pan 41 easily rides on and passes over the obstruction by being guided by this high rigid portion. Moreover, since the front side wall section 5 has an inclination so that as a position on the front side wall section 5 gets closer to the vehicle rear side, the front side wall section 5 as a whole is located in the lower position in the vehicle up-and-down direction, the oil pan 41 can ride on the obstruction while converting the external force inputted from the obstruction to the oil pan 41 to a force of the vehicle up-and-down direction.

Hence, also in this fourth embodiment, almost the same working and effect as those of the first embodiment can be obtained, and the resin-made oil pan 41 without breakage even when the oil pan 41 strikes against the obstruction can be obtained without thickening a thickness of the oil pan 41 (without increasing weight of the oil pan 41).

Here, the oil pan of the present invention can be applied to variety of the oil pans disposed at a lower side of the vehicle. For instance, the oil pan of the present invention can be used for an oil pan that is secured to a lower surface of a transmission (not shown) mounted on the vehicle and stores lubricating oil supplied to each part of the transmission.

In each embodiment described above, regarding the FRP-made bottom unit 10, although its inner and outer surfaces are not coated or covered with the resin when molding the oil pan, a part, of or almost of the inner and outer surfaces could be coated or covered with the resin when molding the oil pan. In this case, thickness of the bottom unit 10 might be set to be relatively thinner at this coated part in order to avoid weight increase of the oil pan due to the coat of the bottom unit 10 with the melted resin.

Further, the oil pan of each embodiment described above has the structure in which the resin material is molded to the FRP-made bottom unit 10. However, the bottom unit could be formed only by the resin material by the molding without using the FRP-made bottom unit 10.

EXPLANATION OF REFERENCE

1 . . . oil pan
2 . . . bottom wall
3 . . . side wall
4 . . . flange
5 . . . front side wall section
6 . . . rear side wall section
7 . . . lateral rib
8 . . . lattice rib
9 . . . bolt insertion hole
10 . . . bottom unit

The invention claimed is:

1. An oil pan secured to a lower portion of a vehicle and made of resin material, comprising:

a bottom wall having a front side wall section that is located at a vehicle front side and a rear side wall section that is horizontally located at a vehicle rear side with respect to the front side wall section and continues to the front side wall section at a predetermined angle; and an external force absorption section that is provided at the front side wall section and inclines downward in a vehicle up-and-down direction toward the vehicle rear side and moderates and absorbs an external force that is inputted to the front side wall section, wherein the external force absorption section comprises a plurality of resin-made longitudinal ribs that protrude from an outer wall surface of the front side wall section so as to extend along a vehicle front-and-rear direction, and each of the longitudinal ribs is formed so that the vehicle rear side portion of each of the longitudinal ribs is relatively thick and the top end of the vehicle rear side portion of each of the longitudinal ribs becomes relatively thinner toward the vehicle front side.

2. The oil pan as claimed in claim 1, wherein a cross sectional shape of a longitudinal rib gradually changes from a wedge shape to an isosceles trapezoid shape from the vehicle front side toward the vehicle rear side.

3. The oil pan as claimed in claim 2, wherein the cross sectional shape of the longitudinal rib further gradually changes from the isosceles trapezoid shape to a rectangular shape from the vehicle front side toward the vehicle rear side.

4. The oil pan as claimed in claim 1, wherein as a position of a longitudinal rib gets closer to the vehicle rear side, a protruding amount from the outer wall surface of the front side wall section of the longitudinal rib becomes greater.

5. The oil pan as claimed in claim 1, wherein a longitudinal rib is formed so that the vehicle rear side portion of the longitudinal rib is relatively thick in a vehicle width direction and the top end of the vehicle rear side portion of the longitudinal rib becomes relatively thinner in the vehicle width direction toward the vehicle front side.

6. The oil pan as claimed in claim 1, wherein the longitudinal ribs are provided at regular intervals in a vehicle width direction.

7. The oil pan as claimed in claim 1, wherein the longitudinal ribs are provided at irregular intervals in a vehicle width direction.

* * * * *